United States Patent [19]

Chiaramonte, Jr.

[11] 4,112,601

[45] Sep. 12, 1978

[54] DYNAMICALLY ILLUMINATED FOOTWEAR

[76] Inventor: Gasper Chiaramonte, Jr., 229 Court Ave., Lyndhurst, N.J. 07071

[21] Appl. No.: 780,490

[22] Filed: Mar. 23, 1977

[51] Int. Cl.[2] ..... A43B 23/00; F21V 33/00

[52] U.S. Cl. ..... 36/137; 362/103

[58] Field of Search ..... 36/137; 240/6.4 W, 10.1, 240/60, 46.55, 46.49; 350/98

[56] References Cited

U.S. PATENT DOCUMENTS

| | | | |
|---|---|---|---|
| 3,743,828 | 7/1973 | Fiorenzo et al. | 240/10.1 |
| 3,963,917 | 6/1976 | Romano | 240/6.4 W |
| 4,020,572 | 5/1977 | Chairamonte | 36/137 |

FOREIGN PATENT DOCUMENTS

| | | | |
|---|---|---|---|
| 1,072,485 | 9/1954 | France | 36/137 |
| 444,392 | 3/1936 | United Kingdom | 36/137 |

*Primary Examiner*—Patrick D. Lawson

*Attorney, Agent, or Firm*—William H. Maxwell

[57] ABSTRACT

Shoes constructed of light transmitting material to receive a light source and modulator unit for changing the coloration of high intensity light intermittently emitted to illuminate the said shoes.

6 Claims, 4 Drawing Figures

FILTER SEGMENTS - Red, Blue, Green & Yellow.

DYNAMICALLY ILLUMINATED FOOTWEAR

BACKGROUND

This invention relates to footwear wherein the platform of a shoe is illuminated, such as disclosed in my U.S. Pat. No. 4,020,572 entitled ILLUMINATED FOOTWEAR issued May 3, 1977. In said Patent and the prior art thereto, the light sources have been invariable as to coloration and the light projected therefrom; rather than variable coloration through the shoe platform which is a general object of this invention.

Platform shoes have developed in various forms and one of which is the "wedge" wherein the sole, instep and heel are integral and in appearance present a solid. The wedge is of course styled and/or sculptured to have the desired appearance, generally tapered from top to bottom, the top surface being contoured to comfortably fit the sole of a persons foot and the bottom surface with or without a heel and substantially flat for ground engagement. Also, in plan view the width is contoured to have conformity with the shape of the persons foot, the front sole section being wider as a rule than the rear heel section. Such platform wedges are generally made of solid materials except as disclosed in aforesaid U.S. Pat. No. 4,020,572 and they have been molded with hollowed interiors for the saving of materials etc. It is this hollowed construction and adaptability to interior illumination which is advantageously employed by this invention, as will be described.

This invention relates to specialty footwear, for entertainment purposes and the like, and it is the extraordinary appearance and coloration of the shoe which is desired. It is this appearance and coloration of the shoe per se which takes precedence over the projection of light therefrom, it being an object to brilliantly illuminate or light the shoe platform structure and/or riser thereof that is visible to the observer or audience. To this end, the shoe structure or riser is made of light transmitting material into which light of varying color is beamed by a light change means that sequentially modulates color.

It is an object of this invention to provide a light modulator for the purpose above described, and preferably a means that sequences the color of light emitting from a source thereof and transmitted into the body of a shoe structure, and namely into the riser of a shoe platform. With the present invention, the light modulator is a module replaceable in the shoe platform, and motivated by an external or internal power source to intermittently discharge high intensity light through a color change or filter means. The said color change or filter means is preferably in the form of a rotating beacon, and all of which is cooperatively combined with the shoe structure for its extraordinary illumination.

SUMMARY OF INVENTION

The footwear herein disclosed is dynamically illuminated by a light modulator that sequentially changes the coloration of light beamed into the visible shoe structure from a high intensity intermittently activated light source. The footwear is embodied in a pair of shoes of platform configuration wherein the riser is made of light transmitting material adapted to receive and be illuminated by light beamed thereto. The shoe platform is of shell-form having a chamber into which the light modulator is inserted as a unit. And, the light modulator unit involves a high intensity light source that intermittently discharges light through a light change means which filters the light so as to sequentially produce variations in color, such as the basic colors red, green, blue and yellow. As is shown, the light modulator unit is replaceable within the heel portion of the shoe platform and is switch controlled from an external power source, the light change means being in the form of a rotating beacon.

DRAWINGS

The various objects and features of this invention will be fully understood from the following detailed description of the typical preferred form and application thereof, throughout which description reference is made to the accompanying drawings, in which.

PREFERRED EMBODIMENT

Figure 1:
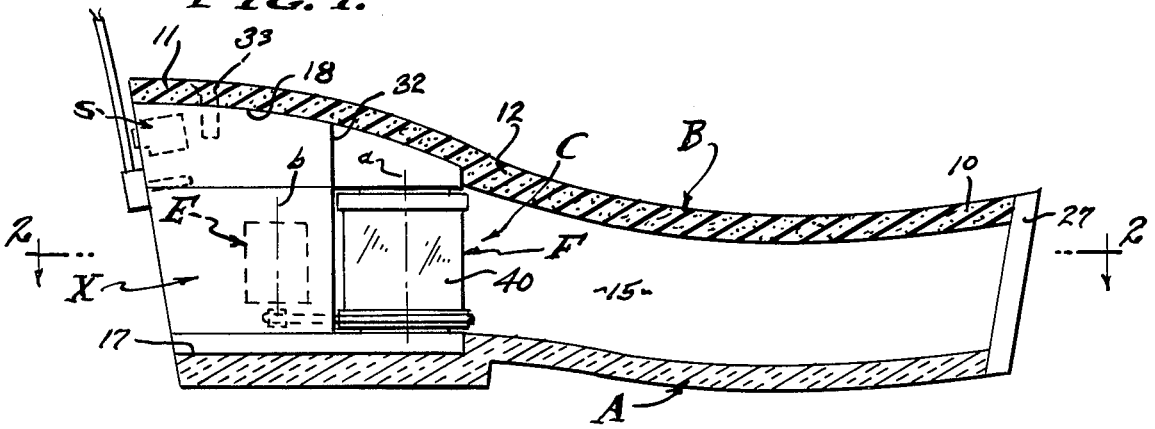
FIG. 1 is a longitudinal cross section through a typical embodiment of the dynamically illuminated shoe of the present invention.
Figure 2:
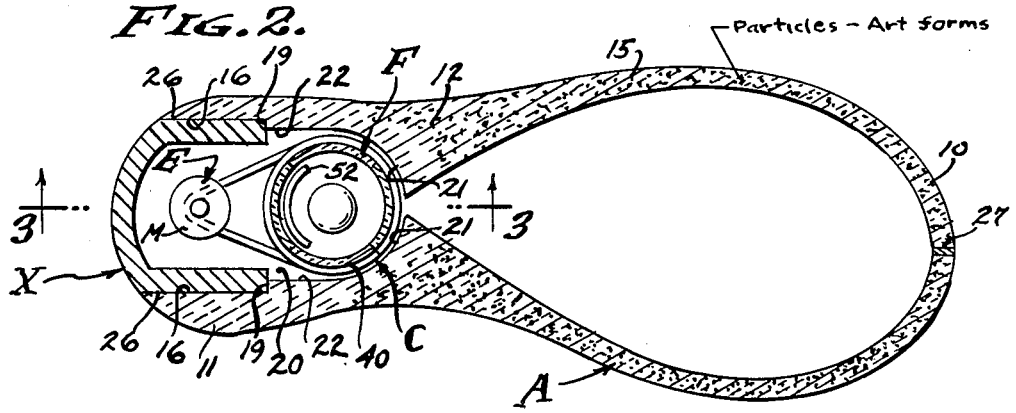
FIG. 2 is a plan section taken as indicated by line 2—2 on FIG. 1.
Figure 3:
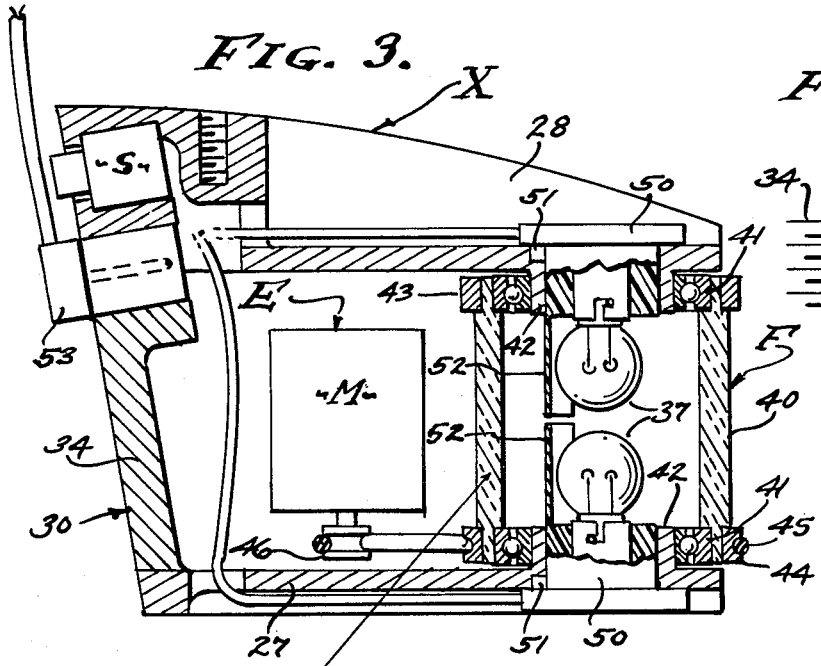
FIG. 3 is an enlarged detailed view of the light modulator unit removed from the receptacle in the shoe platform and taken substantially as indicated by line 3—3 on FIG. 2, and, FIG. 4 is an electrical diagram of the high intensity illumination circuit.
Figure 4:
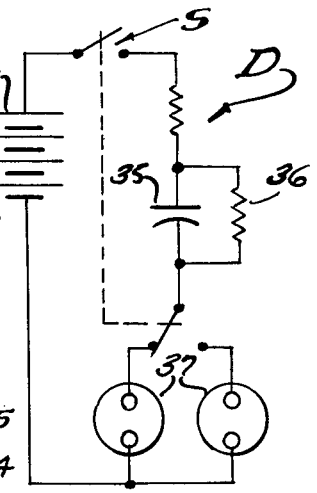

Referring now to the drawings, a typical wedge-shaped platform shoe is shown in FIG. 1 and comprised of a sole-heel A, an instep B, and a riser C therebetween chambered or of shell-form to receive the light modulator unit X that is insertable into the heel portion of the chamber. As shown, the sole-heel A and instep B are spaced by the riser C to present a raised platform, with a plan configuration having a front toe section 10, a rear heel section 11 and an intermediate arch section 12. In accordance with normal shoe design, the heel is the deepest section that fairs into the toe via the arch, the members A-C being in the form of separate structural members adapted, when assembled, to sustain the standing weight applied by the foot of the wearer. Accordingly, the sole-heel A and instep B are made of the usual opaque substances formed to a suitable configuration such as that shown, and all of which are assembled and secured together in the usual manner as circumstances require.

The sole-heel A and instep B are comprised of heel, toe and arch sections joined by a perimeter wall 15 that comprises the riser C. In accordance with this invention, the wall 15 wraps around the toe section and extends rearward at both the inside and outside of the arch section and terminates at the heel section to establish a rearward opening to the chamber within the opposite side walls. In practice, the inner faces 16 of the opposite side walls are spaced and parallel, establishing a receptacle having a bottom face 17 defined by the heel section of the sole-heel A, and having a top face 18 defined by the heel section of the instep B. The depth of the receptacle is established by coplanar shoulders 19 in each side wall 15. Forward of the said shoulders 19 there is a recess 20 of semi-cylindrical form adapted to cooperatively receive the light change means F, later described. As shown, the recess 20 is comprised of a pair of complementary concaved inner surfaces 21 of the opposite walls 15 and formed concentric with a common vertical axis *a*. The said two semi-cylindrical surfaces are rearwardly disposed and continue in tangentially related inner surfaces 22 extending rearward in spaced parallel relation and terminating at the shoulders 19 respectively.

A feature of this invention is the transmission of light through the wall 15 of the riser C, for the purpose of brilliantly illuminating the same. In practice, clear acrylic plastic material is employed therefor and which conducts light within its solid substance configuration and along its curvilinear extent. The walls 15 can be tinted and they can encapsulate various art forms of reflective material to be made visible by light conducted through the substance of the wall in which they are visibly buried. For example, metalic particles (as indicated) are encapsulated in the substance of the wall or walls 15. A feature is an opaque separator 27 that bi-laterally divides the side walls 15 so that the illumination at the two sides of the shoe is distinct.

Referring now to the light modulator unit X that characterizes this invention, the formation thereof is complementary to the receptacle and recess as described above and established between the two side walls 15. That is, the unit X occupies the open heel portion of the shoe platform, between the top and bottom faces 18 and 17, and between the side interfaces 16. Accordingly, the unit X is comprised of a body 30 having sides 26 slideably engageable with the faces 16 of the receptacle, and a top 28 and a bottom 27 slideably engageable with the faces 18 and 27 respectively. The body 30 is also comprised of a rear wall 31 that is, in practice, a convex continuation between the opposite side walls 15, when the front wall 32 thereof is in seated engagement with the shoulders 19. It will be seen that the light modulator unit X occupies the receptacle and closes the rearward opening into the riser C, to be secured thereto as by a fastener 33 or the like.

The body 30 of the light modulator unit X is a chambered element closed by the top 28 and the bottom 27, to house a power source or control D therefor and a motor means E for the light change means F. For example, the control D is a basic timed discharge circuit as shown, wherein a battery 34 charges a capacitor 35 as controlled by a resistor 36, the timed discharge being through a gas filled lamp 37 or the like, to intermittently emit high intensity light. The motor means E is, for example, an electrical motor M disposed on a vertical axis *b* spaced and parallel to the aforesaid axis *a*.

The top 28 and bottom 27 are plate-like members that enclose the means D and E within the body 30, and which extend forwardly in parallel relation to conformably engage in the recess established by the faces 21 and 22. The said top and bottom members are spaced and parallel extensions of the body 30, there being a power cord 38 extending from between the body 30 and top 28, and there being a three-way switch S carried by top 28 and exposed externally for manual engagement at the rear of the platform. In accordance with this invention the light change means F is a dynamic color filter that moves between the lamp 37 and the two interfaces 21 at the opposite side walls 15. In its preferred form, the light change means F is a segmented cylinder 40 of the sequentially basic colors red, green, blue and yellow, carried upon anti-friction bearings 41 supported upon opposed bosses 42 on the top and bottom members 28 and 27 respectively. The color segments of the cylinder 40 can be integrally joined as by welding or cementing them together, or secured as by encompassing rings 43 and 44. The lowermost ring 44 is formed as a pulley to receive a drive belt 45 extending over a drive spindle 46 of motor M. As shown, the filter cylinder 40 is held juxtaposed and closely spaced from the faces 21 of the wall 15 so as to revolve thereby without engagement.

In accordance with this invention the heat change means F with its rotating cylinder 40 is a beacon that distributes a color sequence of light through the faces 21 and into the solid substance of the walls 15 at both sides of the shoe platform. The light source therefor, and namely the lamp 37, is carried within the cylinder 40 and on the axis *a*. To this end, there is a lamp holder 50 that extends through the bearing 41 at the end of the cylinder, into which the lamp is secured centrally within the cylinder chamber. The holder 50 is rotatably positioned by a key 51 and carries a reflector 52 that projects the lamp light toward the riser faces 21. In practice, there is a pair of lamps 37 in circuit with the controlling discharge circuit D through releasable plug-in connectors 53 and entering the cylinder chamber through the bottom and top members 27 and 28. The holders 50 are frictionally held in the members 27 and 28, and they are captured in position as and when the modulator unit X is placed in working position, as shown. The switch S has an "off" position and alternately selective "on" positions for the two coaxial (on axis *a*) lamps 37.

From the foregoing it will be seen that I have provided a durable high intensity light source for footwear, wherein dynamic color variations are made visible through the transparent platform of light conductive material. The light source intermittently discharges through the rotating filter beacon having basic color segments closely juxtaposed to the riser faces through which the said light is transmitted into the riser body sides for its illumination. The changing colors are confined to the separated sides of the riser by the opaque separator therebetween, and the power for operation is preferably available from a battery pack and master control carried on the person of the wearer, and the energy transmitted to the modulator unit via the cord 38.

Having described only a typical preferred form and application of my invention, I do not wish to be limited or restricted to the specific details herein set forth, but wish to reserve to myself any modifications or variations that may appear to those skilled in the art:

I claim:

1. In combination with a shoe platform having a riser comprised of a curvilinear perimeter wall of light transmitting material that conducts light within its solid substance and with a receptacle and an adjoining recess therein; a light modulator means comprising a power supplied body carried in the receptacle and a light source energized thereby with a color change means comprised of a series of color filters moveably disposed within said recess and means moving the same between the light source and light transmitting material of the riser.

2. The shoe platform and light modulator means combination as set forth in claim 1, wherein the color change means comprises a cylinder with the light source therein and of color filter segments rotatable between the light source and light transmitting material of the riser and motivated by said means moving the same within said body.

3. The shoe platform and light modulator means combination as set forth in claim 1, wherein the color change means comprises a cylinder with the said light source and a reflector therein and of color filter segments rotatable between said light source and light transmitting material of the riser and motivated by said means moving the same within said body.

4. In combination with a shoe platform having a riser of light transmitting material comprised of a curvilinear perimeter wall conducting light within its solid substance and along its curvilinear extent and with a receptacle and an adjoining recess therein comprised of a semi-circular face at each side wall of the riser; a removable light modulator means comprising a power supplied body carried in the receptacle and a light source energized thereby with a color change means comprised of a series of color filters juxtaposed to said semi-circular faces respectively and between the light source and light transmitting material of the riser and motivated by means included within said body.

5. The shoe platform and light modulator means combination as set forth in claim 4, wherein the color change means comprises a cylinder of color filter segments rotatable over the light source extending coaxially within bearing means for the said cylinder.

6. The shoe platform and light modulator means combination as set forth in claim 4, wherein the color change means comprises a cylinder of color filter segments rotatable over a pair of light sources extending coaxially within bearing means at each opposite end of said cylinder.

* * * * *